United States Patent [19]

Czerwinski

[11] 4,047,178

[45] Sept. 6, 1977

[54] LOW LOSS TOP TERMINATION FOR SHORT MONOPOLES

[75] Inventor: Watson Peter Czerwinski, Forked River, N.J.

[73] Assignee: The United States of America as represented by the Secretary of the Army, Washington, D.C.

[21] Appl. No.: 725,217

[22] Filed: Sept. 22, 1976

[51] Int. Cl.[2] ..... H01Q 9/36

[52] U.S. Cl. ..... 343/750; 343/752

[58] Field of Search ..... 343/749, 752, 899, 745, 343/750

[56] References Cited

U.S. PATENT DOCUMENTS

| | | | |
|---|---|---|---|
| 3,513,473 | 5/1970 | Seward | 343/752 |
| 3,967,276 | 6/1976 | Goubau | 343/752 |

*Primary Examiner*—Alfred E. Smith
*Assistant Examiner*—David K. Moore
*Attorney, Agent, or Firm*—Nathan Edelberg; Jeremiah G. Murray; Michael Zelenka

[57] ABSTRACT

A top termination for short monopoles is disclosed which reduces transmission losses by placing the series inductor outside the top-capacitor-to-ground field while coupling the top capacitor to the monopole through said series inductor.

1 Claim, 2 Drawing Figures

LOW LOSS TOP TERMINATION FOR SHORT MONOPOLES

BACKGROUND OF THE INVENTION

In the field of transmission of radio waves by means of a monopole antenna it is well known that the optimum physical length of the monopole should be equal to a quarter wavelength to provide a purely resistive impedance at the antenna base without the use of compensating inductance or capacitance. At lower frequencies, however, wavelengths become sufficiently long so as to make monopole antennas having the ideal ¼ wavelength dimension cumbersome and impractical. Accordingly, the antenna length has been reduced while a compensating inductance or capacitance or both have been added so that the electrical length of the shortened antenna approaches the electrical length of the idea ¼ wavelength antenna. In one form such a monopole antenna utilizing both capacitive and inductive compensation employs a capacitor hat atop the antenna, being electrically coupled thereto by a coil in series with the radiator. Generally speaking, it is desireable to mount the inductor near the top capacitor since this configuration permits the maximum current in the radiator and therefore the greatest antenna efficiency, that is, the effective height for any given monopole is maximized. In the past the proximity of the series inductor to the top capacitor has been a limiting factor in the positioning of the series inductor, since, as the position of the series inductor approaches the top capacitor, the circulating current between the top capacitor and the series inductor increases, thereby decreasing antenna efficiency. The object of this invention therefore is to reduce the circulating current between the series inductor and the top capacitor while providing the maximum effective heights for any given monopole length.

SUMMARY OF THE INVENTION

The invention entails the mounting of the series inductor above the top capacitor, out of the field of the top capacitor to ground, while coupling the top capacitor to the radiator through the series inductor in order to maximize the effective length of the radiator. Since the series inductor is out of the top-capacitor-to-ground field, the top-capacitor-to series-inductor circulating current is minimized. The invention further reduces inductor losses by eliminating the requirement for metal shielding and provides for essentially uniform current distribution through the radiator. As a result of this reduction in circulating current and other inductor losses, observations indicate the effective radiated power is increased approximately fourfold for a given input power. In the referred embodiment a plurality of inductances are selectable by means of a switching arrangement thereby providing a tuning feature permitting the reception of selected sub-bands.

DETAILED DESCRIPTION OF THE INVENTION

Figure 1:
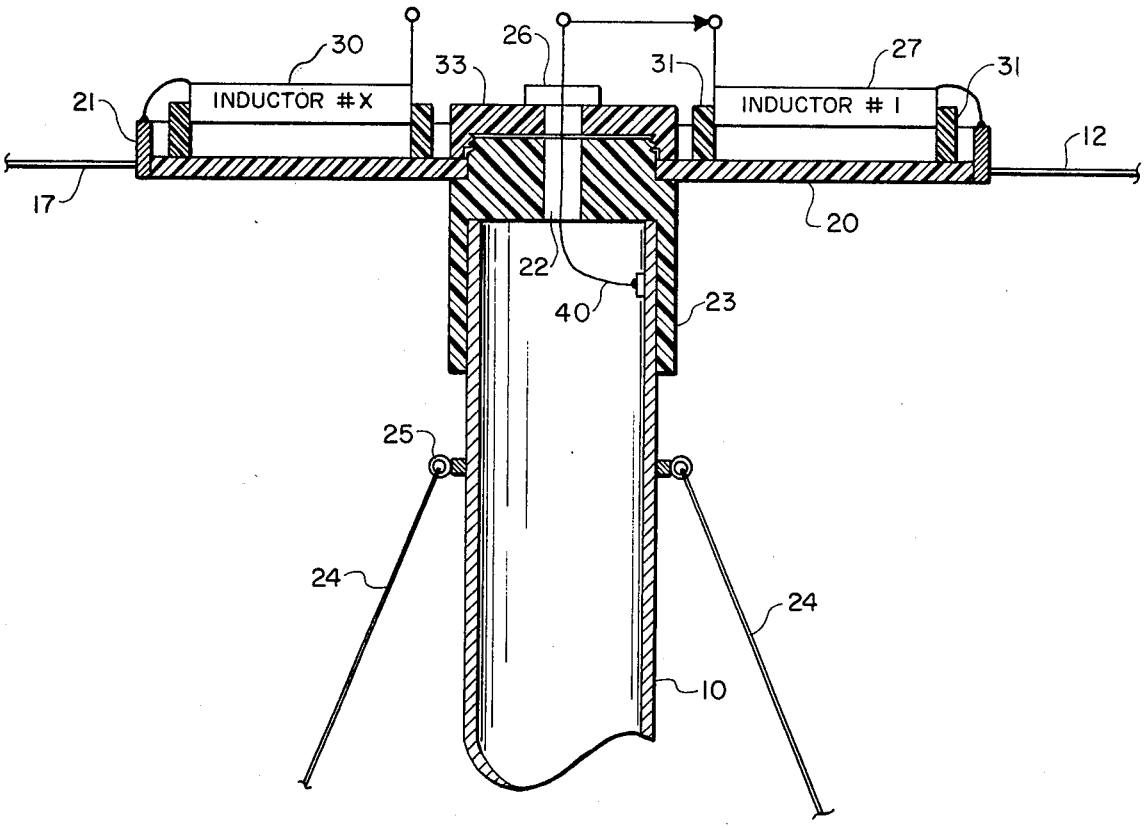
FIG. 1 is a view of the invention is section.
Figure 2:
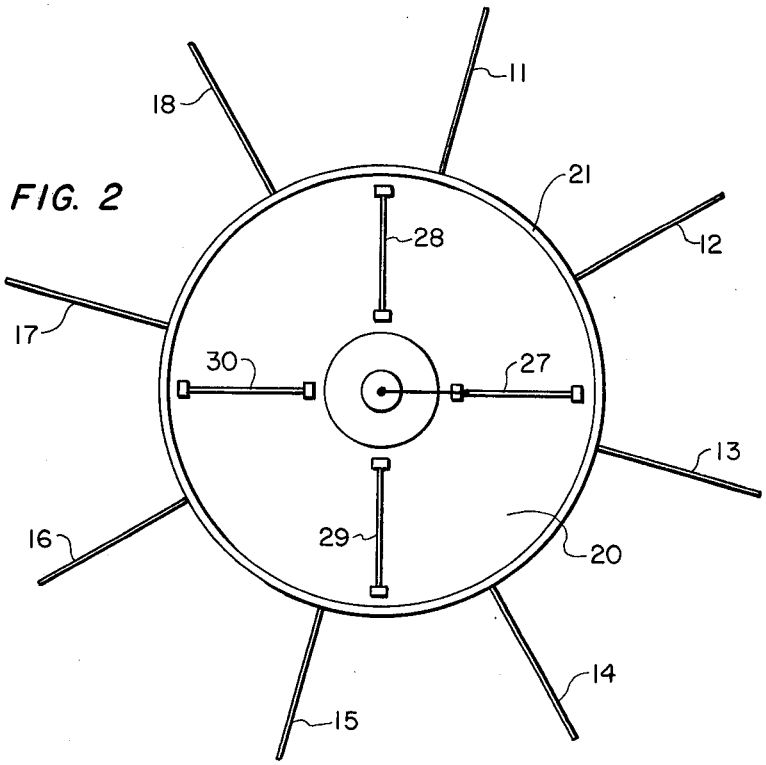
FIG. 2 is a top view of the invention.

FIG. 1 is a sectional view of an antenna having a top termination in accordance with the invention. It shows a monopole 10, having a top termination comprising radial whips 11–18, nonconductive support plate 20 fitted with conductive ring 21, monopole insulator 23 and series inductors 27–30. The monopole 10 is held in the vertical position by guidelines 24 attached to collar 25. As may be seen from the drawing, monopole insulator 23 fits over the end of monopole 10 and serves both as an insulator and mounting support for nonconductive support plate 20. An insulative top cap 33 is positioned above monopole insulator 23 so as to sandwich nonconductive support plate 20 between said top cap 33 and monopole insulator 23 and thereby hold said nonconductive support plate 20 fixedly positioned. In the preferred embodiment illustrated in FIG. 1 this is accomplished by providing a step down threaded portion on the end of monopole insulator 23 opposite the end which fits over the monopole 10. A clearance hole 22 is provided in nonconductive support plate 20 so that the support plate will fit over the threaded portion of monopole insulator 23 and abut the stepped portion thereof. The insulative top cap 33 is tapped to accept the threaded portion of monopole insulator 23 thereby permitting the securing of nonconductive support plate 20 as previously described. Insulative top cap 33 and monopole insulator 23 are both fitted with a clearance hole which allows electrical coupling through conductor 40 between monopole 10 and any one of the inductors which are disposed radially around the nonconductive support plate 20 by means of switch 26. FIG. 2 illustrates a top view of this arrangement.

The inductors 27–30 differ in value so as to provide an antenna of the correct electrical length for a series of different frequencies and are preferably wound with Litz wire so as to minimize their inherent capacity. The embodiment illustrated in the figures is so arranged that normal selection of the proper inductor is made prior to erection of the antenna, however a more sophisticated arrangement providing for the switching of inductors 27–30 through a servo-system or the remote control of a variable inductor is anticipated. While four inductors 27–30 are shown in the preferred embodiment this number is not intended to limit the scope of the invention. The inductors 27–30 are mounted on the nonconductive support plate 20 by means of mounting hardware 31 which may be formed of conductive or nonconductive material.

The conductive ring 21 is fixedly positioned around the circumference of the nonconductive support plate 20 and one end of each of the inductors 27–30 is electrically coupled thereto. Eight metal whips 11–18 are positioned evenly around the circumference of the conductive ring 21 and extend radially therefrom. These eight metal whips 11–18 are electrically coupled to the conductive ring 21 and with it comprise the top capacitor. Eight whips were chosen for the preferred embodiment since that number appeared to optimize the effective capacitance. Additional whips were found merely to add to the weight of the top termination. The use of eight whips in the preferred embodiment, however, is in no way intended to limit the scope of the invention.

The mounting arrangement described removes the series inductor from the top capacitor-to-ground field while maintaining coupling of the top capacitor to the radiator through the series inductor thereby increasing the effective length of the antenna.

What is claimed is:

1. A capacitor and inductor compensated monopole antenna comprising:

A monopole antenna having an upper and lower end;

capacitor means comprising a plurality of metallic whips insulated from said monopole antenna and located at the upper end thereof;

a plurality of inductors, physically positioned above said capacitor means; and, coupling means for electrically coupling said capacitor means to said monopole antenna selectively through any of said plurality of inductors.

* * * * *